US010767956B2

(12) United States Patent
Popov

(10) Patent No.: US 10,767,956 B2
(45) Date of Patent: Sep. 8, 2020

(54) ULTRA-COMPACT CROSSBOW

(71) Applicant: Sergey Popov, Moscow (RU)

(72) Inventor: Sergey Popov, Moscow (RU)

( * ) Notice: Subject to any disclaimer, the term of this patent is extended or adjusted under 35 U.S.C. 154(b) by 0 days.

(21) Appl. No.: 16/233,254

(22) Filed: Dec. 27, 2018

(65) Prior Publication Data

US 2020/0208937 A1 Jul. 2, 2020

(51) Int. Cl.
*F41B 5/12* (2006.01)

(52) U.S. Cl.
CPC ..... *F41B 5/123* (2013.01)

(58) Field of Classification Search
CPC ..... F41B 5/10; F41B 5/12; F41B 5/123
See application file for complete search history.

(56) References Cited

U.S. PATENT DOCUMENTS 3,987,777 A * 10/1976 Darlington ..... F41B 5/10 124/25.6
4,077,385 A * 3/1978 Fredrickson ..... F41B 5/10 124/25.6
4,461,267 A * 7/1984 Simonds ..... F41B 5/10 124/25.6
6,776,148 B1 * 8/2004 Islas ..... F41B 5/10 124/25.6
7,578,289 B2 * 8/2009 Norkus ..... F41B 5/0094 124/25
7,823,572 B2 * 11/2010 Anderson ..... F41B 5/123 124/25
7,891,348 B2 * 2/2011 Colley ..... F41B 5/123 124/25
8,651,095 B2 * 2/2014 Islas ..... F41B 5/105 124/25
9,297,604 B1 3/2016 Sidebottom et al.
9,354,015 B2 * 5/2016 Yehle ..... F41B 5/105
10,190,841 B2 * 1/2019 Laurence ..... F41B 5/123

* cited by examiner

*Primary Examiner* — John A Ricci
(74) *Attorney, Agent, or Firm* — Cantor Colburn LLP

(57) ABSTRACT

A crossbow that includes a frame along which a movement trajectory of an arrow substantially passes, a first limb and a second limb connected to the frame on opposite sides from the movement trajectory. Each of said limbs having a loose end. The crossbow further includes a first cam having a first rotation axle and a second cam having a second rotation axle. The cams rotatably arranged on a first holder and on a second holder, respectively. The holders fixed on said frame on opposite sides from the movement trajectory. In addition, the crossbow is provided with a bowstring connecting the first cam and the second cam, a first cable connecting the first cam and the loose end of the first limb, and a second cable connecting the second cam and the loose end of the second limb.

19 Claims, 3 Drawing Sheets

ULTRA-COMPACT CROSSBOW

FIELD OF THE INVENTION

The present invention relates to devices for firing arrows (or projectiles), in particular to crossbows.

BACKGROUND OF THE INVENTION

Numerous varieties of crossbows are known in the art that ensure a high initial speed of an arrow. This is achieved by means of using cables, rollers, cams, cam holders, and limbs.

The closest analog to this invention may be a crossbow according to U.S. Pat. No. 9,297,604, wherein the holders with the cams arranged thereon are attached to the stock assembly. The limbs are also attached to the stock assembly. The bowstring connects the cams. The first cable connects the first cam to the first limb and the second limb. The second cable connects the second cam to the second limb and the first limb. When the bowstring is being drawn, each of the cams wraps around the cable track to a cable length that corresponds to movement distance of these two limbs. Therefore, the cable track on the cam should have a great length. It is apparent that this arrangement of the cables compromises arrow's initial speed. Furthermore, the fact that the cables cross the crossbow stock negatively affects said initial speed achieved with this crossbow due to the formation of a friction node. Another shortcoming of this crossbow is a rather great width of the device, which is defined by the arrangement of the limbs on the two sides of the cams.

SUMMARY OF THE INVENTION

The object of this invention is to provide a crossbow device having a simplified structure in comparison to the known analogs and having more compact dimensions, which would be preferable for carrying and using the crossbow, and, at the same time, providing a high initial speed to an arrow.

This object is achieved owing to the fact that limb ends to which cables are attached in the claimed crossbow do not extend beyond the limits of axles around which the cams rotate in any state of the device. This ensures a minimum crossbow width defined by arrangement of the cams. The cables do not pass near movement trajectory of an arrow, i.e. their projections in the plane of the device for firing arrows do not cross a projection of said movement trajectory in the said plane. This enables to avoid formation of a friction node at a frame of the crossbow. Each of the cables connects the related cam to one limb only. This enables to use the cams with a short track, which, in turn, enables to increase an initial speed of an arrow.

According to the first aspect of this invention, a crossbow comprises a frame, a first holder attached with a first end thereof to the frame, a first cam having a first rotation axle arranged at a second end of the first holder, a second holder attached with a first end thereof to the frame, and a second cam having a second rotation axle arranged at a second end of the second holder. The device also comprises a first limb attached with a first end thereof to the frame on the same side as the first holder, and a second limb attached with a first end thereof to the frame on the same side as the second holder. A bowstring connects the first cam and the second cam. A first cable connects the second end of the first limb to the first cam, and a second cable connects the second end of the second limb to the second cam. The second end of the first limb and the second end of the second limb are always located between the first rotation axle and the second rotation axle.

In another aspect of the invention, a crossbow comprises a frame, a first holder attached with a first end thereof to the frame, a first cam having a first rotation axle arranged at a second end of the first holder, a second holder attached with a first end thereof to the frame, and a second cam having a second rotation axle arranged at a second end of the second holder. The device also comprises a first limb having two loose ends and at least one end attached to the frame on the same side as the first holder, and a second limb having two loose ends and at least one end attached to the frame on the same side as the second holder. A bowstring connects the first cam and the second cam. At least one first cable connects the loose ends of the first limb with the first cam, and at least one second cable connects the loose ends of the second limb with the second cam. The loose ends of the first limb and the second limb are always located between the first rotation axle and the second rotation axle.

The first holder and the second holder may be fixed (rigid). They may be manufactured as one part attached to the frame, or as separate parts, or as parts integrated with the frame. Said rotation axles, when arranged on such fixed holders, will be also fixed when the bowstring is being drawn.

Alternatively, the first holder and the second holder may be made movable, e.g. they may be produced with the use of an elastic or flexible (elastically flexible) material. Said rotation axles, when arranged on such movable holders, will be also movable when the bowstring is being drawn. Here it should be noted that mobility of said holders, when the bowstring is being drawn, does not provide the crossbow with energy sufficient for firing an arrow. Rather, the energy for firing is provided by the limbs.

BRIEF DESCRIPTION OF THE DRAWINGS

Further the invention will be explained in more detail with references to the drawings showing possible, but not limiting this invention, embodiments of the crossbow according to the first aspect and the second aspect, wherein.

DESCRIPTION OF THE ILLUSTRATED EMBODIMENTS

Figure 1:
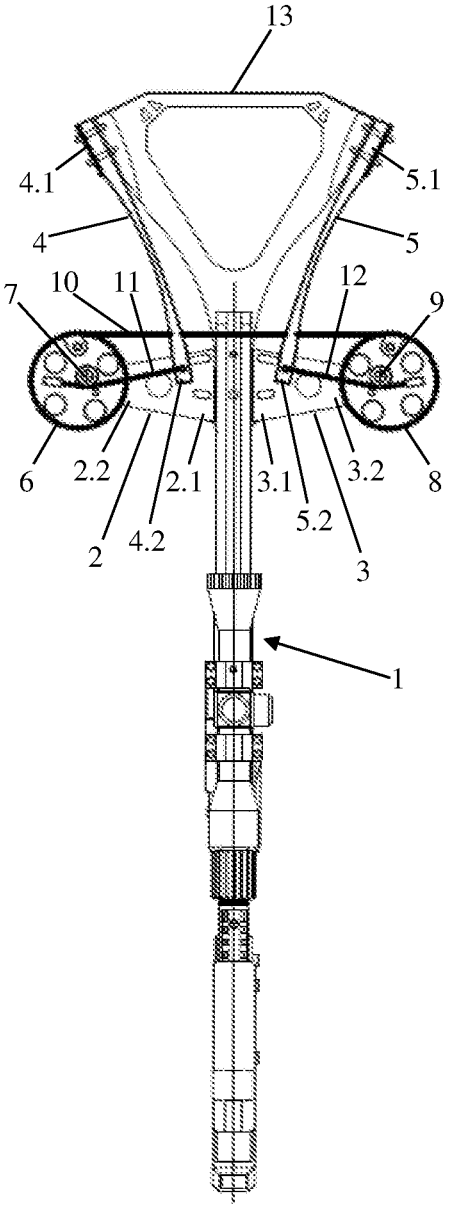
FIG. 1 shows one embodiment of the crossbow according to this invention.

According to the invention, a crossbow comprises a frame 1 to which the following elements are attached: a first holder 2 with a first end 2.1 thereof, a second holder 3 with a first end 3.1 thereof, a first limb 4 with a first end 4.1 thereof, and a second limb 5 with a first end 5.1 thereof.

The first holder 2 and the first limb 4 are located on one side of the frame 1, while the second holder 3 and the second limb 5 are located on the other side of the frame 1.

A first cam 6, which rotates around a first rotation axle 7, is arranged at a second end 2.2 of the first holder 2.

A second cam 8, which rotates around a second rotation axle 9, is arranged at a second end 3.2 of the second holder 3.

The first cam 6 and the second cam 8 are connected by a bowstring 10 used for providing initial speed to an arrow (not shown in the drawings).

A second end 4.2, or a loose end (also "free end"), of the first limb 4 and the first cam 6 are connected by a first cable 11. A second end 5.2, or a loose end (also "free end"), of the second limb 5 and the second cam 8 are connected by a second cable 12. It is well-known that such cables are used for increasing initial speed of an arrow.

The second end 4.2 of the first limb 4 and the second end 5.2 of the second limb 5 are always (i.e. in both released and drawn states of the crossbow) located between the first rotation axle 7 and the second rotation axle 9.

Examples of the claimed crossbow according to the first aspect of the invention are given in FIGS. 1-4 which show some possible embodiments of the crossbow according to both the first aspect and the second aspect of this invention.

Thus, the limbs 4, 5 may be attached to the crossbow frame 1 at a front portion thereof, for example at a foot stirrup 13, so that the second ends 4.2, 5.2 (free ends) face the side opposite to the movement direction of an arrow. In this case the holders 2, 3 together with the cams 6, 8 arranged thereon are located behind the foot stirrup 13, as shown in FIG. 1, or, for example, closer to a middle portion of the frame 1 (not shown in the drawings).

Alternatively, the limbs 4, 5 may be located closer to the middle portion of the frame 1, so that the second ends 4.2, 5.2 (free ends) of the limbs face the side towards the movement direction of an arrow. In such the case, the holders 2, 3 together with the cams 6, 8 arranged thereon are located at the front portion of the frame 1, as shown in FIG. 2.

Figure 3:
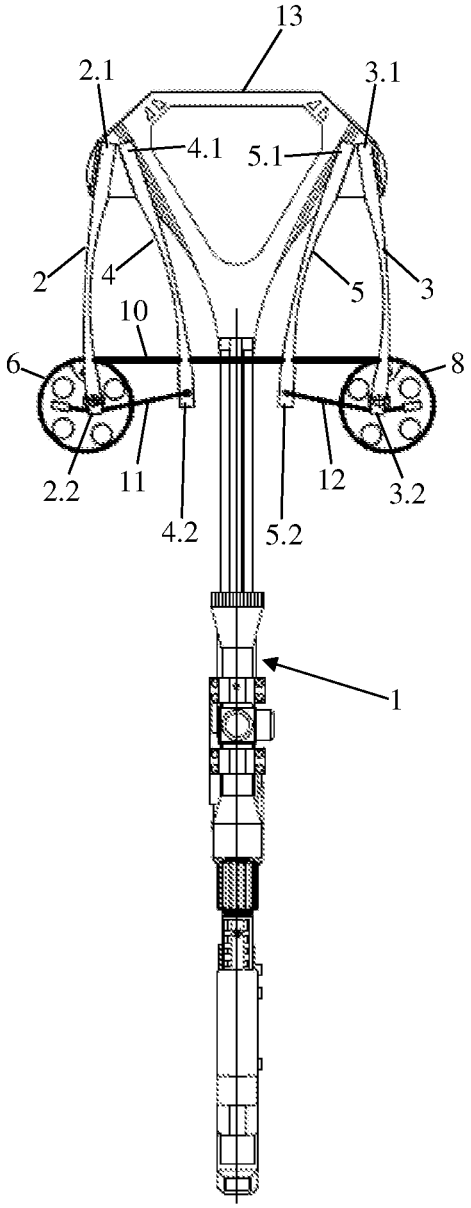
FIG. 3 shows still another embodiment of the crossbow according to this invention.
Figure 4:
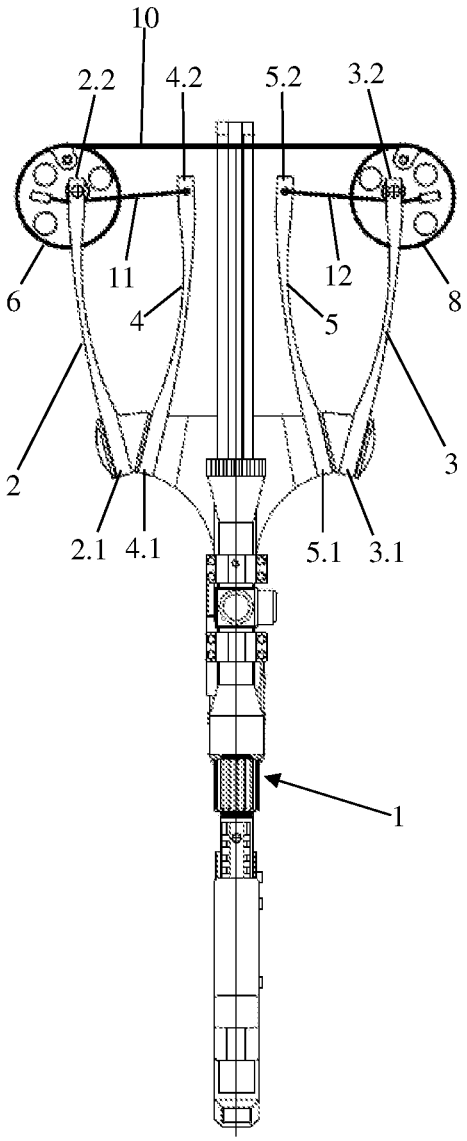
FIG. 4 shows yet another embodiment of the crossbow according to this invention.

The limbs 4, 5 and the holders 2, 3 may be attached with the respective first ends 4.1, 5.1 and 2.1, 3.1 near to each other, as shown in FIGS. 3, 4 where embodiments with different directions of the limbs 4, 5 are shown.

Figure 2:
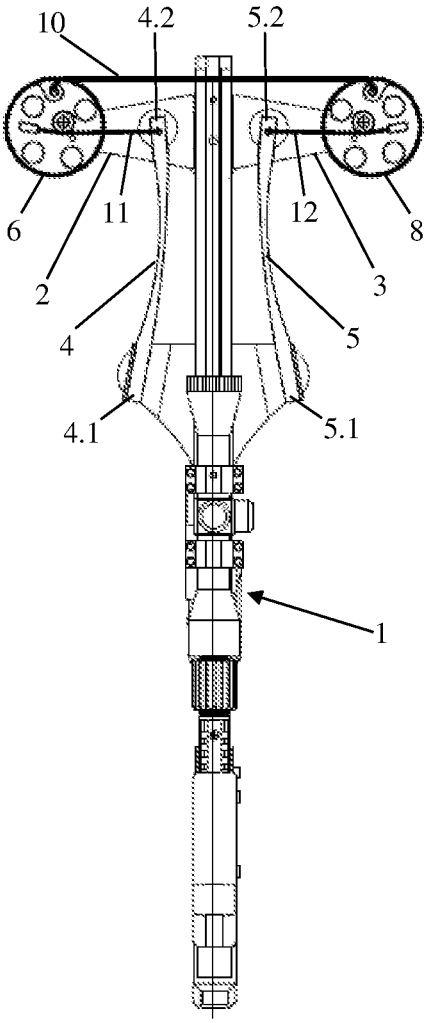
FIG. 2 shows another embodiment of the crossbow according to this invention.

The first holder 2 and the second holder 3 may be made fixed (rigid), as shown in FIGS. 1, 2, i.e. they do not change their respective positions and shapes when the bowstring 10 is being drawn. Said two holders 2, 3 may be as a single part attached to the frame 1, or each of the holders 2, 3 may be a separate part. An embodiment is also possible wherein the holders 2, 3 form a portion of the frame 1. Said rotation axles 7, 9, when arranged on the fixed holders 2, 3, will be also fixed correspondingly when the bowstring 10 is being drawn.

Alternatively, the first holder 2 and the second holder 3 may be made movable, i.e. they may change their respective positions and/or shapes when the bowstring 10 is being drawn. For this, the holders 2, 3 may be made, for example, with the use of an elastic and/or flexible (elastically flexible) material, as schematically shown in FIGS. 3, 4. The rotation axles 7, 9, which are arranged on these movable holders 2, 3 will also be movable when the bowstring 10 is being drawn. Here it should be noted that mobility of said holders 2, 3, when the bowstring 10 is being drawn, cannot provide the crossbow with energy sufficient for firing an arrow. The main energy for firing is provided by the limbs 4, 5 bending under the action of the cables 11, 12 being wrapped around the cams 6, 8 when the bowstring 10 is being drawn.

FIG. 5 shows a front view of the crossbow according to the first aspect of this invention for an embodiment with the rigid holders 2, 3.

In a free (or released) state of the crossbow (FIG. 5*a*), i.e. when the bowstring 10 is not drawn, the bowstring 10 is at least partially wrapped around the cams 6, 8. The second ends 4.2, 5.2 of the respective limbs are located closer to the middle portion of the frame 1, where a movement trajectory of an arrow passes, and at a greater distance from the rotation axles 7, 9.

Figure 5A:
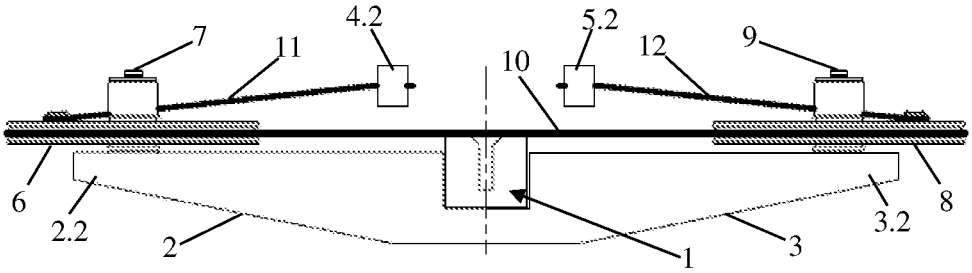
FIG. 5*a* shows a front view of an embodiment of the crossbow according to the first aspect of the invention in a free (or released) state of the crossbow.
Figure 5B:
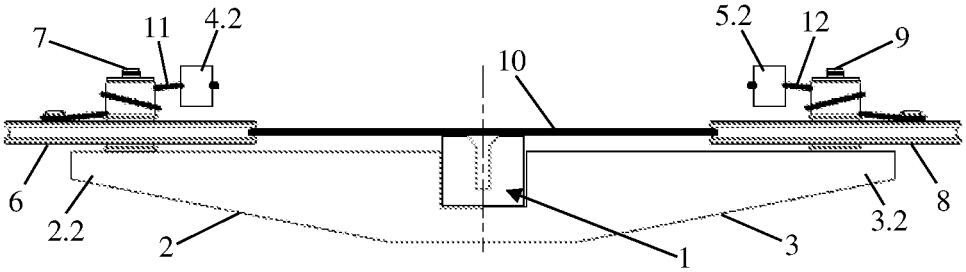
FIG. 5*b* shows a front view of an embodiment of the crossbow according to the first aspect of the invention in the drawn state of the crossbow.

The second ends 4.2, 5.2 of the respective limbs may be located above the bowstring 10, as shown in FIG. 5*a*, and, when the bowstring 10 is drawn, above the respective cams 7, 9, as shown in FIG. 5*b*. Those skilled in the art will understand that an embodiment is also possible where the second ends 4.2, 5.2 of the respective limbs may be located below the bowstring 10 and, when the bowstring 10 is drawn, below the respective cams 7, 9 (not shown in the drawings).

In the drawn state of the crossbow (FIG. 5*b*), i.e. when the bowstring 10 is drawn, the bowstring 10 unwinds off the cams 6, 8 while the cables 11, 12 wrap around the respective cams 6, 8. Meanwhile, the second ends 4.2, 5.2 of the respective limbs move closer to the rotation axles 7, 9 but, according to this invention, do not go beyond the rotation axles 7, 9. Thus, the second ends 4.2, 5.2 of the limbs are always located between the rotation axles 7, 9.

Those skilled in the art will understand that other embodiments of the crossbow according to the first aspect of the invention are possible. It relates both to a design of the holders 2, 3, and to that of the limbs 4, 5 and the cams 6, 8. For example, the limbs 4, 5 may consist of several segments having different rigidity, have the shape of a smoothly curved line or a broken line. The cams 6, 8 may be symmetrical or asymmetrical, and the rotation axles 7, 9 may pass either through the centers of the cams 6, 8, or be offset from said centers.

Figure 6A:
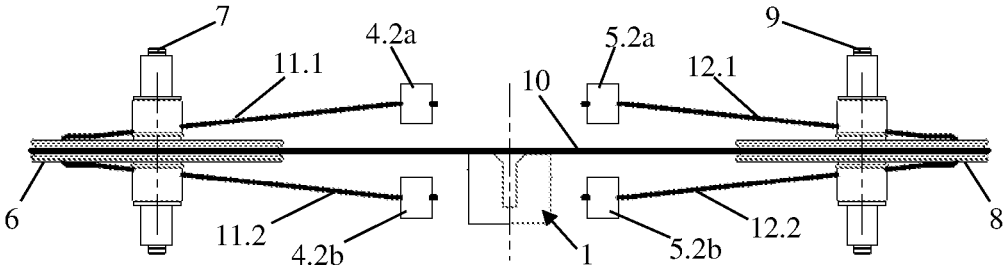
FIG. 6*a* shows a front view of an embodiment of the crossbow according to the second aspect of the invention in a free (or released) state of the crossbow.
Figure 6B:
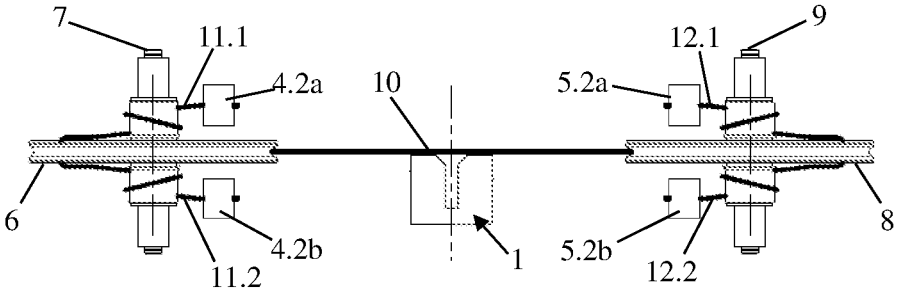
FIG. 6*b* shows a front view of an embodiment of the crossbow according to the second aspect of the invention and in the drawn state of the crossbow.

A crossbow according to the second aspect of this invention is actually similar to the above-described device except for that limbs are made with two loose ends. In order to better understand the difference between the second aspect of this invention and the first one, FIG. 6 shows a front view of the crossbow according to the second aspect of the invention.

Thus, the availability of two second ends 4.2*a* and 4.2*b* of the first limb 4 provides for the use of either one first cable 11 passing from the second end 4.2*a* via the cam 6 to the second end 4.2*b*, or two first cables 11.1 and 11.2 (FIG. 6) which are arranged symmetrically in respect of a passing line of the bowstring 10 and connect, respectively, the second end 4.2*a* and the second end 4.2*b* to the cam 6. The same also relates to the second limb 5: the availability of two second ends 5.2*a* and 5.2*b* of the second limb 5 provides for the use of either one second cable 12 passing from the second end 5.2*a* via the cam 8 to the second end 5.2*b*, or two second cables 12.1 and 12.2 (FIG. 6) which are also arranged symmetrically in respect of the passing line of the bowstring 10, but on the other side of the crossbow frame 1, and connect, respectively, the second end 5.2*a* and the second end 5.2*b* to the cam 8.

Preferably, but not limited to, if one second end 4.2*a* of the first limb and one second end 5.2*a* of the second limb are located, respectively, above the first cam 6 and the second cam 8, and the other second end 4.2*b* of the first limb and the other second end 5.2*b* of the second limb are located, respectively, below the first cam 6 and the second cam 8, when the bowstring 10 is drawn. This ensures a uniform load applied to the cams 6, 8, the rotation axles 7, 9 and, ultimately, on the holders 2, 3.

In the other respects the crossbows according to the first aspect and the second aspect of this invention are identical, i.e. the above description of the crossbow is equally applicable to them.

As it follows from the above description and the accompanying drawings, in no one of the embodiments and the aspects of the crossbow according to this invention the cables 11, 12, 11.1, 11.2, 12.1, 12.2 do not pass and generally may not pass near the movement trajectory of an arrow (not shown in the drawings), since projections of the cables 11, 12, 11.1, 11.2, 12.1, 12.2 and a projection of said movement trajectory in the plane of the device for firing arrows do not cross. Meanwhile, the geometric dimensions of the device for firing arrows are defined solely by the arrangement of the cams 6, 8, rather than by the second ends 4.2, 5.2, 4.2*a*, 4.2*b*, 5.2*a*, 5.2*b* of the limbs. The second ends 4.2, 5.2, 4.2*a*, 4.2*b*, 5.2*a*, 5.2*b* of the limbs are always between the first rotation axle 7 and the second rotation axle 9.

This crossbow design enables to reduce its transverse geometric dimensions significantly, while maintaining one of the most important characteristics of a crossbow, namely, a high initial speed of an arrow. It is also important to know that one more advantage of the proposed crossbow embodiments is its simple structure requiring neither complex cam systems, nor additional rollers for shifting cables off the arrow movement trajectory, etc.

What is claimed is:

1. A crossbow, comprising:

a frame along which a movement trajectory of an arrow substantially passes, a first limb and a second limb connected to the frame on opposite sides from the movement trajectory, each of said limbs having a loose end, a first cam having a first rotation axle and a second cam having a second rotation axle, said cams rotatably arranged on a first holder and on a second holder, respectively, said holders fixed on said frame on opposite sides from the movement trajectory, a bowstring connecting the first cam and the second cam, a first cable connecting the first cam and the loose end of the first limb, and a second cable connecting the second cam and the loose end of the second limb, wherein in both released and drawn states of the crossbow, the loose end of the first limb and the loose end of the second limb are located between the first rotation axle and the second rotation axle, and wherein only a projection of the bowstring to a plane of the crossbow crosses a projection of the movement trajectory to said plane.

2. The crossbow of claim 1, wherein the first cable is located completely on one side with the first cam relative to the movement trajectory, and the second cable is located completely on one side with the second cam relative to the movement trajectory.

3. The crossbow of claim 1, wherein each of the limbs consists of two or more limb portions.

4. The crossbow of claim 1, wherein the first holder and the second holder are made immovable when the bowstring is being drawn.

5. The crossbow of claim 1, wherein the first holder and the second holder are made movable, when the bowstring is being drawn.

6. The crossbow of claim 1, wherein the first holder and the second holder are made integral with the frame.

7. The crossbow of claim 1, wherein the first holder and the second holder are made separate from the frame.

8. The crossbow of claim 1, wherein t the first holder and the second holder are made as a single part.

9. The crossbow of claim 1, wherein, when the bowstring is drawn, the loose end of the first limb is located above the first cam, and the loose end of the second limb is located above the second cam.

10. The crossbow of claim 1, wherein, when the bowstring is drawn, the loose end of the first limb is located below the first cam, and the loose end of the second limb is located below the second cam.

11. A crossbow, comprising:

a frame along which a movement trajectory of an arrow substantially passes, a first limb and a second limb connected to the frame on opposite sides from the movement trajectory, each of said limbs having two loose ends, a first cam having a first rotation axle and a second cam having a second rotation axle, said cams rotatably arranged on a first holder and on a second holder, respectively, said holders fixed on said frame on opposite sides from the movement trajectory, a bowstring connecting the first cam and the second cam, at least one first cable connecting the first cam and said two loose ends of the first limb, and at least one second cable connecting the second cam and said two loose ends of the second limb, wherein said two loose ends of the first limb are located between the movement trajectory and the first rotation axle, and wherein said two loose ends of the second limb are located between the movement trajectory and the second rotation axle.

12. The crossbow of claim 11, wherein said at least one first cable is located completely on one side with the first cam relative to the movement trajectory, and said at least one second cable is located completely on one side with the second cam relative to the movement trajectory.

13. The crossbow of claim 11, wherein each of the limbs consists of two or more limb portions.

14. The crossbow of claim 11, wherein the first holder and the second holder are made immovable, when the bowstring is being drawn.

15. The crossbow of claim 11, wherein the first holder and the second holder are made movable, when the bowstring is being drawn.

16. The crossbow of claim 11, wherein the first holder and the second holder are made integral with the frame.

17. The crossbow of claim 11, wherein the first holder and the second holder are made separate from the frame.

18. The crossbow of claim 11, wherein the first holder and the second holder are made as a single part.

19. The crossbow of claim 11, wherein, when the bowstring is drawn, one loose end of the first limb and one loose end of the second limb are located above the first cam and the second cam, respectively, and the other loose end of the first limb and the other loose end of the second limb are located below the first cam and the second cam, respectively.

* * * * *